United States Patent [19]

Selk

[11] Patent Number: 4,913,188

[45] Date of Patent: Apr. 3, 1990

[54] PROCESS AND APPARATUS FOR SUPPLYING ADDITIVES AT CONTROLLED RATES

[76] Inventor: Kurt M. Selk, Maxhofstr. 37, D-8000 München 71, Fed. Rep. of Germany

[21] Appl. No.: 199,853

[22] Filed: May 27, 1988

Related U.S. Application Data

[63] Continuation-in-part of Ser. No. 865,148, May 20, 1986.

[51] Int. Cl.[4] ..... F15D 1/02

[52] U.S. Cl. ..... 137/544; 137/587; 137/605; 138/42; 251/127

[58] Field of Search ..... 137/205.5, 564.5, 587, 137/544, 605; 138/42; 251/127, 122, 118

[56] References Cited

U.S. PATENT DOCUMENTS

| | | | |
|---|---|---|---|
| 2,318,206 | 5/1943 | Eisenlohr | 138/42 |
| 2,620,234 | 12/1950 | Schaich | 137/564.5 |
| 3,042,079 | 7/1962 | Swift | 138/42 |
| 3,384,103 | 5/1968 | Lansky | 137/205.5 |
| 3,490,561 | 1/1970 | Colgan | 138/42 X |
| 4,062,424 | 12/1977 | Lyden | 138/42 X |

*Primary Examiner*—Alan Cohan

*Attorney, Agent, or Firm*—Kane, Dalsimer, Sullivan, Kurucz, Levy, Eisele and Richard

[57] ABSTRACT

This invention relates to a process and apparatus for supplying additives at very low, exactly controlled rates to a liquid or gaseous fluid by means of a rate control element consisting of a highly porous sintered material. Such an apparatus is simple in structure and can be used for a reliable supply at very low rates, which are exactly controlled.

4 Claims, 6 Drawing Sheets

Fig. 1
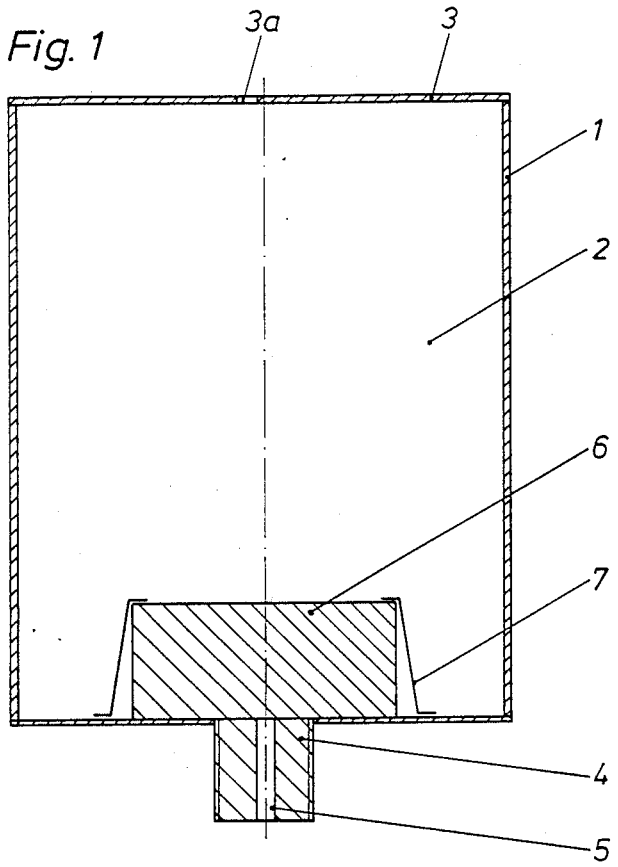
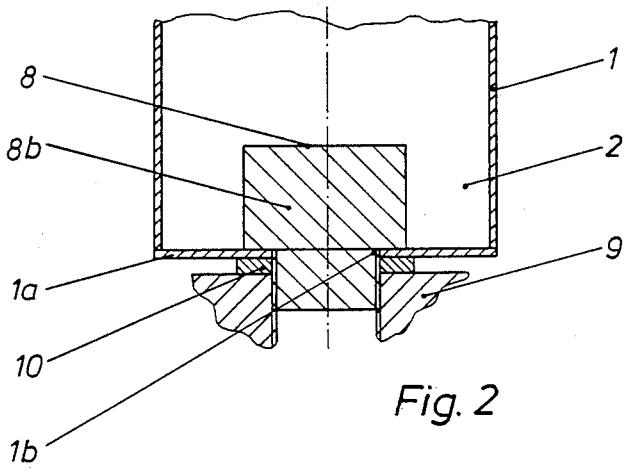
Fig. 2

PROCESS AND APPARATUS FOR SUPPLYING ADDITIVES AT CONTROLLED RATES

CROSS-REFERENCE TO RELATED APPLICATION

This application is a continuation-in-part of U.S. patent application Ser. No. 865,148, filed May 20, 1986, now abandoned.

This invention relates to a process and apparatus for supplying additives at very low, exactly controlled rates to a liquid or gaseous fluid.

It is often necessary to supply additives at very low, but exactly controlled rates to liquid or gaseous fluids, such as lubricants, fuels, or hydraulic liquids. Such additives may be used, e.g., as detergents, dispersing agents, neutralizing components, antioxidants, anti-wear additives, corrosion inhibitors, substances for improving viscosity-temperature behavior, antifoaming agents, combustion promoters, fluidity improvers, etc.

Some of such additives must be supplied when a given plant or equipment is first filled or put into operation or during operation, e.g., in the case of motors, or when the additive has become exhausted.

Known means for supplying additives at low rates to a liquid or gaseous fluid comprise, e.g., wick oilers, drip-feed lubricators, or central lubricating systems. However, such means are not suitable for an exact quantity control in the ppm range.

For the above reason it is an object of the invention to provide an apparatus for supplying additives of very low, exactly controlled rates to a liquid or gaseous fluid, which apparatus comprises a supply space for the additive and a rate control element which is disposed between the supply space and a space for conducting the fluid and which is permeable to the additive, the apparatus being so designed that additives can be very exactly and reliably added in very small quantities (in the ppm range).

That object is accomplished in accordance with the invention in that the rate control element consists of a highly porous sintered material.

Various highly porous sintered metals may be used as sintered materials in the rate control element of the apparatus in accordance with the invention. Such materials particularly include stainless steel, sintered bronze, and, in special cases, corrosion-resistant and high temperature-resistant alloys, particularly alloys which contain nickel, chromium, molybdenum, and/or titanium.

Sintered metals are materials which have been made by powder metallurgy and which are mainly defined by their strength and the pore size as essential criteria.

In accordance with the invention the sintered material has a pore size between 1 μm and 100 μm, preferably between 1 μm and 20 μm.

A sintered material having a pore size between 1 μm and 10 μm is suitable for a supply of low-viscosity additives to liquids, such as gasoline. The pore size of a sintered material for a supply of medium- and high-viscosity additives to liquids, such as medium distillates, fuel oil, and hydraulic oils, but also to gasoline, suitably lies between 1 μm and 20 μm, in general.

The dimensioning of a rate control element of the rate control apparatus in accordance with the invention will now be explained with reference to an example:

It may be assumed that 250 ppm of an inhibitor are to be added to fuel oil, i.e., that a mixing ratio of 1:4000 is to be achieved between the additive and the fuel oil. If that supply of inhibitor is to be effected uniformly through a period of 30 days, the addition of 1 liter of the additive to 4000 liters of fuel oil will correspond to an addition of 1.389 $cm^3$ per hour.

Applicant has found that there is a proportional relationship between the quantity of additive passing through the rate control element per unit if time, the pore size of the rate control element, the dynamic viscosity of the additive, and the dimensions of the rate control element which are essential for flow therethrough, namely, effective flow area and effective thickness. That relationship is represented by the equation:

$$V' = \frac{p \times F}{\eta \times s} \qquad \text{(I)}$$

where

V' is the additive volume rate (1/3600 $m^3$/sec);

p is the specific pore size permeability ($10^{-12}$ $m^2$);

F is the effective flow area of the sintered body ($10^{-6}$ $m^2$);

$\eta$ is the dynamic viscosity $$\left(10^{-3}\,\frac{N\text{sec}}{m^2}\right)$$

(cP); and s is the thickness of the sintered body ($10^{-3}$ m).

Of the above, p and $\eta$ are specific material related properties. The other variables are adjusted according to the requirements.

The above Equation I was derived from the laws of Hagen-Poisseuille and Darcy. It should be noted that the influencing differential pressure ($\Delta P$) is taken as a constant for this determination since it depends entirely on operating conditions, internal resistance, etc., of the system. Here $\Delta P = 1$ bar $= (10^5\ m^2)$, i.e.:

$$V'' = \frac{\Delta P \times p \times F}{\eta \times s} \qquad \text{(1a)}$$

According to Equation I the value V' has empirically been determined for a given additive and a given rate control element. Also, the ratio F/s required to achieve the desired value V' can be calculated.

A change of the pore size, if a different sintered material is used, and a change of $\eta$, if a different additive has been selected, can similarly be taken into account in the determination of V' and of F/s.

From Equation I it can be appreciated that with a change of one variable, the resulting volume flow V' will either increase or decrease. In addition, Equation I can be re-arranged to facilitate calculation of other desired variables. For example:

$$s = \frac{F \times p}{V' \times \eta} \qquad \text{(II)}$$

and $$p = \frac{V' \times s \times \eta}{F} \qquad \text{(III)}$$

The calculated figures have to be confirmed by testing, and then the equations can be adjusted for other volume flow rates.

As mentioned above, stainless steel and bronze are two of the materials which may comprise a sintered body useful according to the invention herein. The characteristics of such materials are as follows:

| STAINLESS STEEL Cr/Ni/Mo 18/12/2 | | |
|---|---|---|
| pore size (μm) | spec. permeability ($10^{-12}$) | density (g/cm$^3$) |
| 1 | 0.3 | 6.3 |
| 3 | 0.75 | 6.3 |
| 5 | 1.0 | 6.3 |
| 10 | 2.0 | 6.3 |
| 15 | 4.0 | 6.3 |
| 20 | 6.0 | 6.3 |
| 200 | 180.0 | 3.8 |

| BRONZE Cu/Sn 90/10 | | |
|---|---|---|
| pore size (μm) | spec. permeability ($10^{-12}$) | density (g/cm$^3$) |
| 8 | 3 | 6.8 |
| 20 | 10 | 6.8 |
| 45 | 50 | 6.8 |
| 200 | 700 | 5.0 |

To demonstrate the efficacy of Equation I, the following exemplary calculations have been performed:

$$p = 1 \times 10^{-12} \text{ (pore size 5 } \mu\text{m)} \quad \text{(A)}$$

$$F = 706 \text{ mm}^2 \text{ (30 mm } \phi)$$

$$s = 20 \text{ mm}$$

$$\eta = 40 \text{ cP/20° C.}$$

$$\Delta P = 1 \text{ bar} = 10^5/\text{m}^2$$

$$\frac{V'}{3600} = \frac{10^5 \times 1 \times 706 \times 10^3 \times 10^3}{1 \times 10^{12} \times 10^6 \times 40 \times 20} = 0{,}000317 \text{ m}^3/\text{h}$$

$$= 371 \text{ cm}^3/\text{h}$$

$$p = 1 \times 10^{-12} \text{ m}^2 \quad \text{(B)}$$

$$F = 3{,}14 \text{ mm}^2 \text{ (2 mm } \phi)$$

$$s = 20 \text{ mm}$$

$$\eta = 40 \text{ cP/20° C.}$$

$$\Delta P = 0.3 \text{ bar}$$

$$V' = 317 \times 0.3 \times \frac{3{,}14}{706} = 0.42 \text{ cm}^{-3}/\text{h}$$

$$p = 0.75 \times 10^{-12} \text{ m}^2 \quad \text{(C)}$$

$$F = 78.5 \text{ mm}^2 \text{ (10 mm } \phi)$$

$$s = 15 \text{ mm}$$

$$\eta = 40 \text{ cP/20° C.}$$

$$\Delta P = 0.3 \text{ bar}$$

$$V' = 317 \times 0.75 \times \frac{78.5}{706} \times \frac{0.3}{1} \times \frac{20}{15} = 10{,}5 \text{ cm}^3/\text{h}$$

Equations II and III can be simplified by the following:

$$V' = 1000 \text{ cm}^3 \quad \text{(D)}$$

-continued $$F = 706 \text{ mm}^2$$

$$\eta = 40 \text{ cP/20° C.}$$

$$\Delta P = 1 \text{ bar}$$

$$s = ?$$

$$s = 20 \times \frac{317}{1000} = 6{,}3 \text{ mm}$$

$$V' = 317 \text{ cm}^3/\text{h} \quad p = ? \quad \text{(E)}$$

$$\eta = 100 \text{ cP/20° C.}$$

$$\Delta P = 1 \text{ bar}$$

$$F = 706 \text{ mm}^2$$

$$s = 20 \text{ mm}$$

$$p = 1 \times \frac{100}{40} = 2.5 \ (10^{-12} m^2)$$

The above examples demonstrate a significant principle of the invention, namely, that adjustments can be made to obtain desired results. The adjustments are made consistent with Equation I or, where applicable, Equation II or III.

The apparatus herein is suitable not only for additive treatment at a constant rate, for example, for heating fuel or diesel fuel, but for situations where the rate of additive treatment changes. The rate can be adjusted by simply replacing the sintered body with a different body having different characteristics, e.g., pore size. Such rate adjustment would be useful in treating industrial oils, such as turbine oils or hydraulic oils, or in metal working.

Some illustrative embodiments of the apparatus in accordance with the invention are diagrammatically shown on the drawings in which:

FIG. 1 is a diagrammatic view showing a first illustrative embodiment of the invention;

FIG. 2 is an illustration of the principle of a second embodiment;

Figure 5:
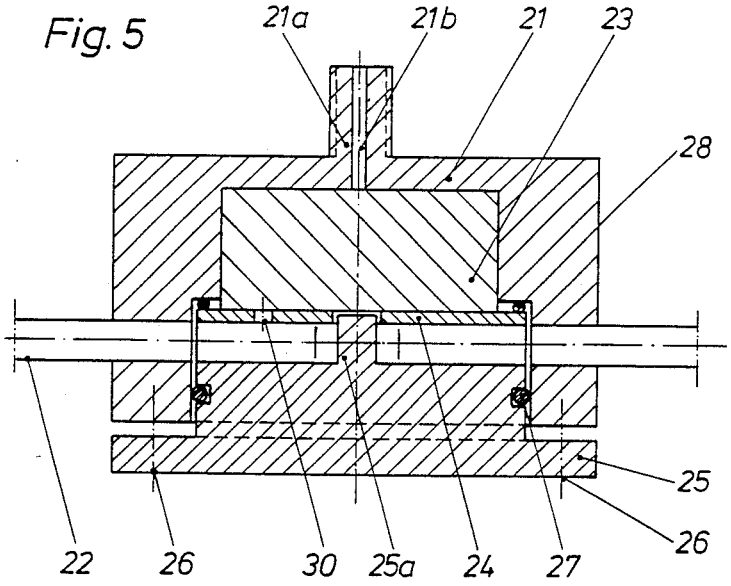
FIG. 5 is a sectional view showing a further illustrative embodiment of the invention.
Figure 7:
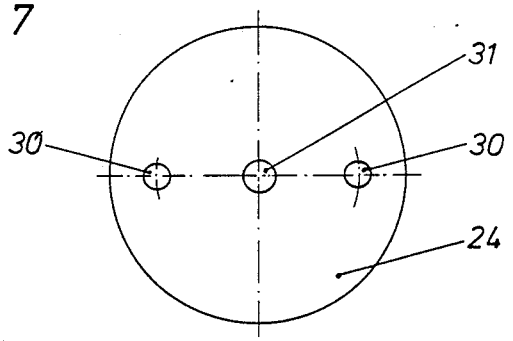
Figure 8:
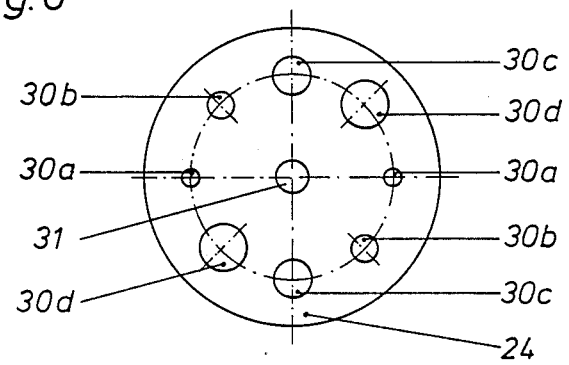
Figure 9:
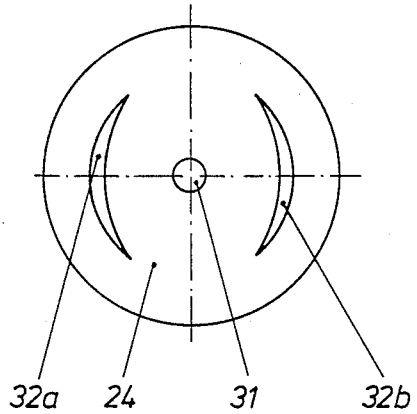
Figure 10:
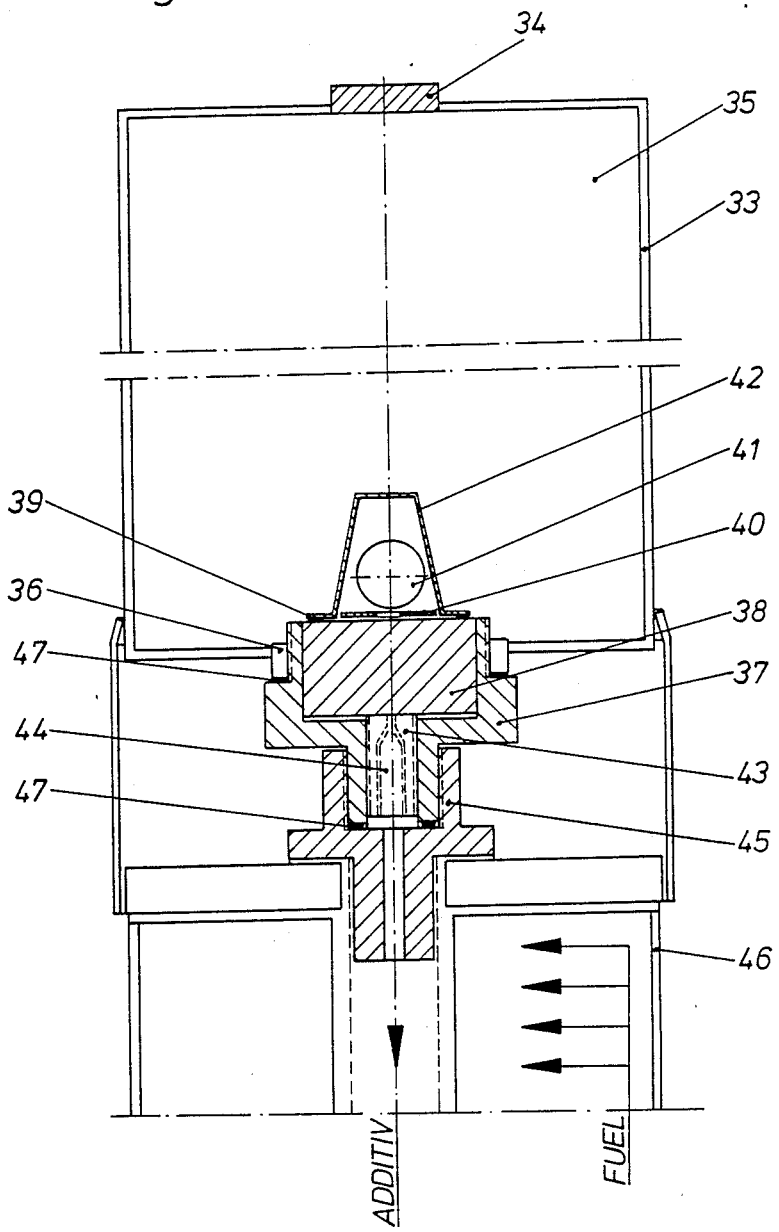
Figure 11:
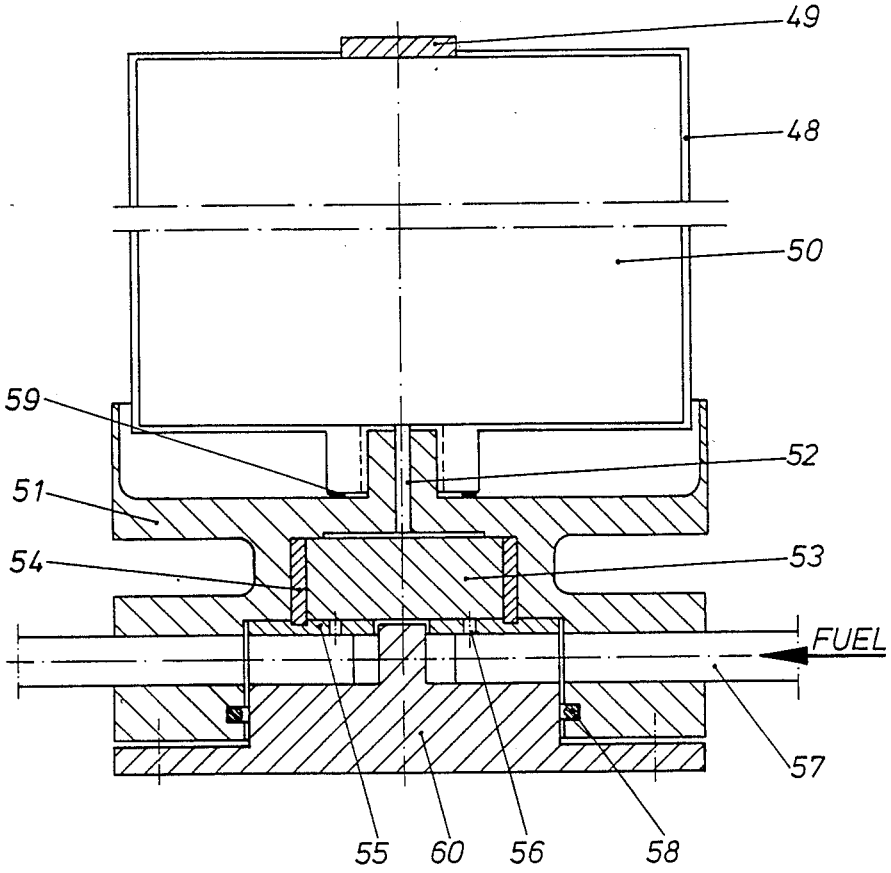
Figure 12:
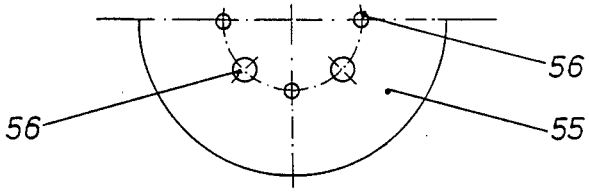

FIGS. 7, 8, and 9 are top plan views showing respective modified control discs for the illustrative embodiment of FIG. 5; and FIGS. 10, 11, and 12 show two practical illustrative embodiments.

The apparatus shown in FIG. 1 for a supply of additives at very low, exactly controlled rates to a liquid or gaseous fluid comprises a supply vessel 1, which encloses a supply space 2 for the additive. The supply space 2 is closed at its top by a cover 3, which is provided with a vent opening 3*a*.

The supply vessel 1 is joined, e.g., by welding, at its bottom to a screw-threaded connecting pipe 4, which has a through bore 5.

The bore 5 is closed toward the supply space 2 by a rate control element 6, which in the embodiment shown by way of example is urged by spring clips 7 against the bottom of the supply vessel 1, i.e., against the top face of the screw-threaded connecting pipe 4.

The rate control element 6 consists of a highly porous sintered metal and permits the additive contained in the supply space 2 to enter the bore 5 only at very low, exactly controlled rates. From the bore 5 the additive enters the liquid or gaseous fluid to be provided with that additive.

For that purpose the screw-threaded connecting pipe 4 of the supply vessel 1 is screwed, e.g., into a pipeline of a container which contains the liquid or gaseous fluid which is to be provided with the additive.

FIG. 2 illustrates a modification in which the rate control element 8 is provided with a screw-threaded connecting pipe 8*a*, which is intended to be fitted into a tapped connecting flange 9 of a space which contains the liquid or gaseous fluid. The lower rim of that portion 8*b* of the rate control element 8 which is disposed in the supply space 2 lies on the bottom 1*a* of the supply vessel 1. The screw-threaded connecting pipe 8*a* extends freely through a bore 1*b* in the bottom of the supply vessel 1. A seal is effected by a sealing element 10 that is disposed between the bottom 1*a* of the supply vessel 1 and the connecting flange 9.

In that embodiment the supply vessel 1 is screw-connected to the connecting flange 9 by means of the rate control element 8, which also constitutes a fixing screw.

Figure 3:
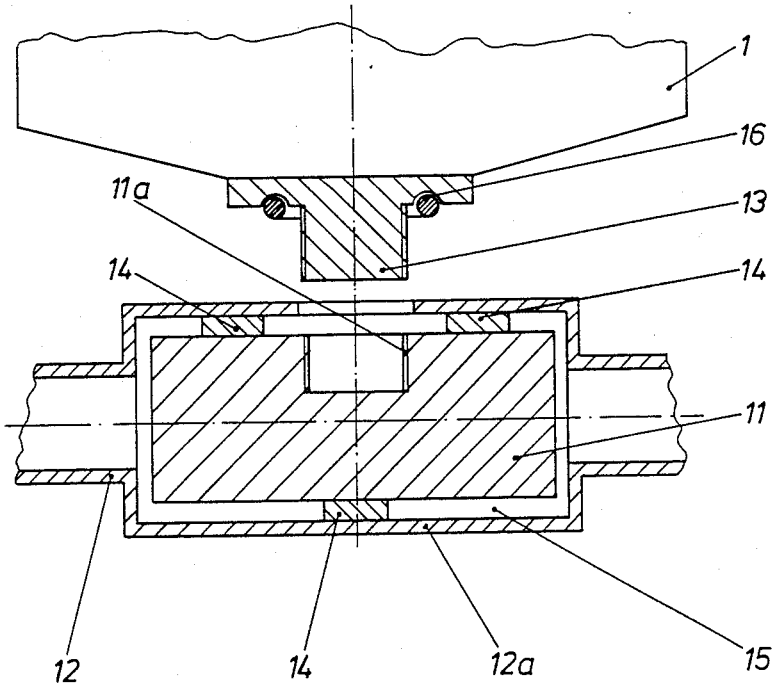
FIG. 3 is a diagrammatic representation of a third illustrative embodiment.

In the further embodiment of the invention shown in FIG. 3, the rate control element 11 consisting of highly porous sintered metal is accommodated in a chamber 12*a*, which is contained in a pipeline 12 for conducting the liquid or gaseous fluid that is to be provided with the additive.

The rate control element 11 is provided with a tapped bore 11*a*. A screw-threaded connecting pipe 13 is provided at the bottom of the supply vessel 1 and can be screwed into the bore 11*a*.

In the chamber 12*a* the rate control element 11 is so held by spacers 14 that a clearance 15 is left between the periphery of the rate control element 11 and the inside surface of the pipeline 12 and the liquid or gaseous fluid to be provided with the aditive can flow through said clearance.

The supply vessel 1 is secured to the pipeline 12 in that the screw-threaded connecting pipe 13 is screwed into the rate control element 11. A sealing element 16 is provided to effect the necessary seal between the screw-threaded connecting pipe 13 and the outside surface of the pipeline 12.

To permit replacement of the rate control element 11 should that be necessary, the pipeline 12 is provided with suitable access openings, not shown.

Figure 4:
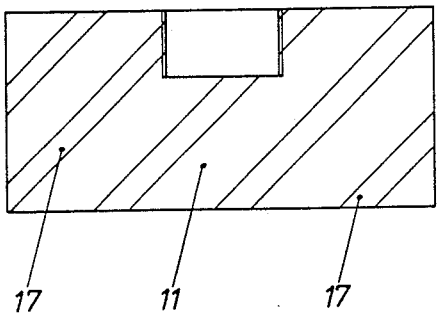
FIG. 4 shows a further modification of the rate control element.

FIG. 4 shows a modification in which the rate control element 11' consists of a substantially cylindrical body, just as is the rate control element 11 of FIG. 3, but is provided on its periphery with a number of preferably helical grooves 17 for conducting the liquid or gaseous fluid that is to be provided with the additive. If the rate control element 11' is used, the clearance 15 provided between the periphery of the rate control element and the inside surface defining the chamber 12*a* may be omitted entirely or in part.

It will be understood that the grooves provided on the periphery of the rate control element may extend axially and may be closely spaced apart. In that case the areas between adjacent grooves may bear on the inside surface defining the space which contains the liquid or gaseous fluid.

In the illustrative embodiment shown, the rate control element is substantially cylindrical. However, other geometric shapes, e.g., a cone, a frustum of a cone, or a sphere, may be adopted within the scope of the invention.

Figure 6:
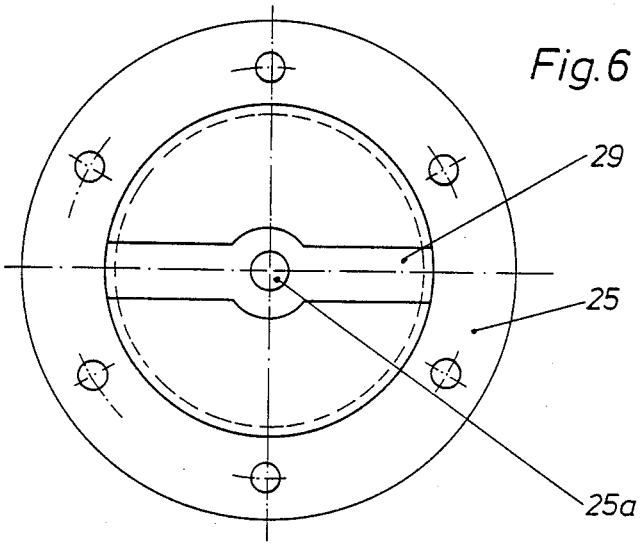
FIG. 6 is a top plan view showing the control cover of the illustrative embodiment of FIG. 5.

The illustrative embodiment shown in FIGS. 5 and 6 is particularly suitable in cases in which additives are to be added at very low rates directly to flow-conducting systems, particularly fuel systems. That apparatus comprises a housing 21, which is connected to a line 22 for conducting, e.g., fuel or lubricant. A rate control element 23 consisting of highly porous sintered material has been fitted into the housing 21 and is covered at its bottom by a control disc 24.

The rate control element 23 and the valve disc 24 are secured in the housing 21 by a control cover 25, which is secured to the housing 21, e.g., by screws 26. Seals are established by respective O-rings 27 and 28 provided on the periphery of the control cover 25 and between the housing 21 and the control disc 24.

The control cover 25 is provided with a passage 29, which constitutes a continuation of the line 22 and has a flow area which is at least as large as that of the line 22.

The control cover 25 is also provided with a central pin 25*a*, which extends through the passage 29 and into a central bore of the control disc 24 to center the latter. The control disc 24 is urged upwardly by the control cover 25.

The control disc 24 is provided with at least one bore 30, which is disposed above the passage 29 and throttles the additive as it flows through the rate control element 23 into the passage 29 and into the fluid flowing through the line 22 and the passage 29.

The housing 21 is provided with a screw-threaded connecting pipe 21*a*, through which a bore 21*b* extends. By means of the screw-threaded connecting pipe 21*a*, the housing 21 can be connected to a supply space for the additive, which supply space is not shown in FIG. 5. As a result, the additive flows from the supply space through the bore 21*b*, the rate control element 23, and the bore 30 into the liquid fluid flowing through the line 22 and the passage 29.

In the embodiments shown in FIG. 7 the control disc 24 is formed with the bore 31 for receiving the pin 25*a* and with two diametrically opposite, constricted bores 30.

In the embodiments shown in FIG. 8 the control disc is formed with a total of four pairs of bores 30, 30*b*, 30*c*, 30*d*, which differ in diameter. The bore diameters may vary, e.g., between 1 mm and 10 mm. In dependence upon the position of the control disc 24, throttling constrictions having different flow areas will be in an effective position over the passage 29.

The setting of the control disc 24 to the desired constricted flow area can be effected, e.g., manually, during the assembling. Suitable detent means for fixing the disc in the several positions are suitably provided.

Different from the embodiment shown, by way of example the control disc 24 may be rotatable so that the constricted flow area can be changed during operation. The control disc 24 may be rotated, e.g., by the control cover 25.

Instead of the illustrated screws 26, screw threads or a bayonet joint may be used to connect the housing 21 to the control cover 25.

FIG. 9 shows finally an illustrative embodiment of the control disc 24 in which the constricted openings are constituted by two diametrically opposite, crescentshaped slots 32a, 32b, rather than by circular bores. In that case too the effective constricted flow area disposed over the passage 29 can be changed by a rotation of the control disc 24.

The apparatus shown may be supplied at an exactly controlled rate, e.g., between 0.1 and 50 $cm^3/h$, preferably between 0.5 and 20 $cm^3/h$.

EXAMPLES

1. Rate Control Apparatus for Heating Systems Operated with Light Fuel Oil. FIG. 10

An additive combination 35 consisting, e.g., of Fe-(III)-2-ethylhexanoate and a corrosion inhibitor consisting of an organic acid has been filled into a vessel 33, which has a capacity of 1.0 to 6.0 liters and is provided with a filling and vent screw 34.

A receiving housing 37 has been screwed in by means of a welded nut 36 and contains a sintered metal 38 having a pore size of 3 μm to 10 μm and dimensions of 30–40 mm×20–25 mm.

The sintered metal is covered at its top by a plate 39, which has a hole and upon which a valve seal 40 provided with a ball 41 is disposed. The ball is held by a cage 42.

A screw 43 has been inserted into the receiving housing 37 and receives the fine adjusting screw 44, which is used for a subsequent adjustment of the rate at which additive emerges from the sintered metal and which can be adjusted in response to an instantaneous power requirement.

The entire superstructure is secured by an adapter screw 45 on top of a filter 46 on the pure side thereof.

The elements of the structure are sealed by sealing elements 47.

2. Rate Control Apparatus for Supplying Additive to Diesel Fuels and Gasoline Fuels for Stationary Engines and Vehicle Engines. FIGS. 11 and 12

An additive combination 50 consisting, e.g., of low-ash or ash-free detergents, combusion promoters, and inhibitors has been filled into a vessel 48 having a capacity of 0.5 to 5.0 liters and provided with a filling and vent screw 49.

A vessel 48 has been screwed on the control housing 51. The additive package flows through the bore 52 into the sintered metal 53, which has a pore size of 1 μm to 5 μm and dimensions of 40–50 mm×20–25 mm. The sintered metal 53 is sealed in the control housing 51 by a rubber cuff 54, which also seals the control disc 55.

The bores 56 in the control disc 55 control the rate at which additive is supplied to the fuel required by the engine (not shown).

Additive enters the fuel line 57 at that controlled rate through the bores 56.

The O-ring 58 and the sealing element 59 prevent a leakage of fuel and additive.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. An apparatus for supplying an additive at a very low, exactly controlled rate at atmospheric pressure to a fluid selected from the group consisting of light fuel oil, medium distillates, and hydraulic oil, which comprises an additive supply space having a vent to the atmosphere;

a rate control element disposal between the additive supply space and an outlet to a fluid-conducting chamber, said rate control element being comprised of highly porous sintered material having pore sizes of from about 3 μm to 10 μm and being permeable to said additive, said outlet comprising a screw means for adjusting flow of said additive; and filter means adjacent to and upstream of said fluid-conducting chamber.

2. The apparatus of claim 1, wherein a plate having a hole is between the additive supply space and the rate control element.

3. The apparatus of claim 1, wherein the additive supply space has an upward vent screw.

4. The apparatus of claim 1, wherein the screw means comprises a fine adjusting screw.

* * * * *